US011065523B2

(12) United States Patent
Kenzle

(10) Patent No.: US 11,065,523 B2
(45) Date of Patent: Jul. 20, 2021

(54) PUNCHING BAG TARGET SUSPENDED FROM SUSPENSION LINE AND MOVEABLE ALONG LINE UNTIL IMPEDED BY BLOCKER

(71) Applicant: Jason Gervais Kenzle, Chestermere (CA)

(72) Inventor: Jason Gervais Kenzle, Chestermere (CA)

( * ) Notice: Subject to any disclaimer, the term of this patent is extended or adjusted under 35 U.S.C. 154(b) by 18 days.

(21) Appl. No.: 16/543,289

(22) Filed: Aug. 16, 2019

(65) Prior Publication Data

US 2020/0061433 A1 Feb. 27, 2020

(30) Foreign Application Priority Data

Aug. 23, 2018 (CA) ..... 3015120

(51) Int. Cl.
*A63B 69/20* (2006.01)

(52) U.S. Cl.
CPC ..... *A63B 69/201* (2013.01); *A63B 2225/093* (2013.01)

(58) Field of Classification Search
CPC ..... A63B 69/201; A63B 2225/093; A63B 2071/0694; A63B 63/06; A63B 69/004; A63B 2069/0044; A63B 2209/00; A63B 2210/50; A63B 69/20–24; A63B 69/34–345; A63B 2225/09–093; A63B 63/00

See application file for complete search history.

(56) References Cited

U.S. PATENT DOCUMENTS 3,372,439 A * 3/1968 Schmid ..... F16L 3/14 24/21
3,924,855 A * 12/1975 Pretorius ..... A63B 69/0084 473/575
4,333,624 A * 6/1982 Raddatz ..... F16M 11/045 248/205.1
4,512,569 A 4/1985 Aragona
4,523,762 A * 6/1985 Garner, Sr. ..... A63B 69/0084 473/473

(Continued)

FOREIGN PATENT DOCUMENTS

WO 2014164745 A1 10/2014

*Primary Examiner* — Andrew S Lo
(74) *Attorney, Agent, or Firm* — ATMAC Patent Services Ltd.; Andrew T. MacMillan

(57) ABSTRACT

A punching bag kit includes a suspension line, a target having a fastening mechanism for suspending the target from the suspension line in a manner allowing the target to move along the suspension line, and a blocker positioned on the suspension line at a configurable distance from the target. The blocker is frictionally held in place on the suspension line at the configurable distance. Movement of the target along the suspension line is restricted upon the fastening mechanism of the target impacting the blocker. The blocker is physically larger than the fastening mechanism thus impeding travel of the fastening mechanism along the suspension line past the blocker. The blocker may have holes through which the suspension line passes, and a spring-loaded friction device may be mounted on the suspension line between two holes. The suspension line may travel around a user in plurality of segments suspending one or more targets.

23 Claims, 11 Drawing Sheets

(56) References Cited

U.S. PATENT DOCUMENTS 4,662,630 A 5/1987 Dignard et al.
4,948,137 A * 8/1990 Alvarez ..... A63B 69/0084 119/708
5,050,866 A 9/1991 Fucci
5,348,293 A * 9/1994 Smith ..... A63B 67/10 473/474
5,554,088 A 9/1996 Zlojutro
6,273,376 B1 * 8/2001 Montgomery ..... A47G 25/1457 24/298
7,857,734 B2 12/2010 Miller et al.
8,721,505 B2 * 5/2014 Conarty ..... A63B 69/206 482/89
9,114,298 B2 * 8/2015 Ruggiero ..... A63B 69/0084
9,782,651 B2 * 10/2017 Ruggiero ..... A63B 69/20
10,159,224 B1 * 12/2018 Horrigan ..... A01K 39/0106
2003/0125168 A1 * 7/2003 Hackaday ..... A63B 69/206 482/89
2005/0227825 A1 * 10/2005 Kutov ..... A63B 69/205 482/83
2007/0117694 A1 * 5/2007 Fitzmaurice ..... A63B 21/4013 482/124
2010/0248908 A1 * 9/2010 Ramsay-Matthews ..... A63B 69/004 482/89
2010/0323852 A1 * 12/2010 Locsin ..... A63B 21/4017 482/96
2012/0091294 A1 * 4/2012 Cuadrado ..... A63B 69/201 248/95
2012/0190510 A1 * 7/2012 Wang ..... A63B 21/4035 482/91
2012/0252637 A1 * 10/2012 Pellot ..... A63B 69/206 482/89
2012/0277074 A1 * 11/2012 Zeldakov ..... A63B 21/4035 482/126
2013/0065735 A1 * 3/2013 Conarty ..... A63B 69/20 482/89
2013/0143724 A1 * 6/2013 DeMeo ..... A63B 23/03508 482/131
2013/0324378 A1 * 12/2013 Rountree ..... A63B 23/0355 482/129
2014/0013509 A1 * 1/2014 Gravett ..... A47G 9/068 5/494
2014/0051549 A1 * 2/2014 Hunter ..... A63B 21/4043 482/24
2015/0060501 A1 * 3/2015 Trusiak ..... A47G 25/485 223/91
2018/0065015 A1 * 3/2018 Claustre ..... A63B 69/0064
2018/0140894 A1 * 5/2018 Ross ..... A63B 21/028
2019/0282880 A1 * 9/2019 Bortolotto ..... A63B 69/201
2020/0269116 A1 * 8/2020 Boisture ..... A63B 69/345
2020/0298041 A1 * 9/2020 Liu ..... A63B 7/02

* cited by examiner

PUNCHING BAG TARGET SUSPENDED FROM SUSPENSION LINE AND MOVEABLE ALONG LINE UNTIL IMPEDED BY BLOCKER

CROSS-REFERENCE TO RELATED APPLICATIONS

This application claims the benefit of priority of Canadian Application No. 3,015,120 filed Aug. 23, 2018, which is incorporated herein by reference.

BACKGROUND OF THE INVENTION

(1) Field of the Invention

This invention is generally related to punching bags. More specifically, the invention relates to punching and kicking strike systems and kits that allow for customizable placement and movement of targets around a user during training.

(2) Description of the Related Art

Combat sport punching and kicking target bags have been used and been recorded throughout the history of the world, for training militaries for combat, training athletes for Olympic sport, martial artists, boxers and MMA fighters also utilize punching and kicking target bags to prefect proper punching and kicking motions, most train with striking pads, large cylindrical style heavy bags, speed bags, free standing heavy models or do pad work with live training partners.

Today's punching bags/striking systems are still imposing, unchanging, disruptive, loud, needing dedicated space, difficult to set up, difficult to store, heavy and require the use of hand protection.

There is a need for a punching system that helps combat all these issues for therapy, home use and gym applications.

BRIEF SUMMARY OF THE INVENTION

According to an exemplary embodiment of the invention there is disclosed a punching/kicking device that comprises a two-ended horizontal suspension line component, one end looped and one end free, the looped end able to secure to a multitude of different types of stationary objects in a couple of securement fashions, and the free end able to travel around multiple stationary objects pulling tight and securing back to itself after the last stationary object with the assistance of a tension device located on said suspension line component. The suspension line component holds the needed tension supporting the multiple interchangeable punching and kicking targets and control methods therein.

According to an exemplary embodiment of the invention there is disclosed a method to control travel of attachable/removable targets using two blocking mechanisms for every one attachable/removable target, blocking mechanisms are larger than attachable/removable target's attaching mechanism thus impeding travel past blocking mechanism of said attachable/removable target; said blocking mechanisms interact directly with horizontal support member, freely moving along or affixing in place on said support member and are user defined.

According to an exemplary embodiment of the invention there is disclosed a range of attachable/removable generally cylindrical striking target bags, varying in size, weight, and other physical characteristics and connecting/removing from said horizontal suspension line component via opening/closing ring or clipping mechanism, current practice utilizes carabiner clip. Attaching of target bag between pair of affixed blocking mechanisms allows target bag to traverse horizontal suspension component laterally along said suspension component and to also reciprocate said suspension component in a controlled manner, but not limited to this. Target bags may range in densities. Target bags may range in diameters. Target bags may range in length. Target bags may also attach to another target bag or multiple target bags.

According to an exemplary embodiment of the invention there is disclosed a punching and kicking device that comprises a two-ended horizontal suspension line component and blocking mechanisms to control the travel of interchangeable targets along suspension line.

According to an exemplary embodiment of the invention there is disclosed a home base mount used to engage height adjustment mechanism: rotational motion of hitching post to raise or lower the height of the connected suspension line.

According to an exemplary embodiment of the invention there is disclosed a range of interchangeable cylindrical striking target bags with varying physical characteristics and connecting to the horizontal suspension line component using a clipping mechanism. Physical characteristics that may be adjusted include size, shape, weight, density, filling material, outer covering and colour, thereby allowing a plurality of target configurations.

According to an exemplary embodiment of the invention there is disclosed an improved punching and kicking strike system that allows for customizable placement of targets 360 degrees around the user. Heights of the targets are adjustable as are the targets themselves.

According to an exemplary embodiment of the invention there is disclosed a striking system that has the ability to easily change hanging targets with a clipping mechanism or closing ring mechanism.

According to an exemplary embodiment of the invention there is disclosed a strike system that is defined by the number and style of strike targets used, which can both be configured by the user.

According to an exemplary embodiment of the invention there is disclosed a strike system that has a horizontal support member with two ends, one closed end loop and one free end line. The support member with the assistance of an interactive device has the ability to attach to multiple stationary objects and cover a range of distances pulling and maintaining desired line tension back to said interactive device on said support member.

According to an exemplary embodiment of the invention there is disclosed a strike system allowing a user to determine how the support member is used, and at what height and what directions the support member travels.

According to an exemplary embodiment of the invention there is disclosed a strike system that provides flexibility, easily adjusting and adapting to a multitude of differing environments, as well as adjusting and adapting to one's personal training needs.

According to an exemplary embodiment of the invention there is disclosed a strike system that can be easily transported on one's person.

According to an exemplary embodiment of the invention there is disclosed a punching and kicking strike system that allows for customizable placement of targets around a user. Target suspension mechanism and portable design allow for quick mounting in a variety of environments. Interchangeable punching bags are attached using a clipping mechanism and provide targets in a range of sizes and densities suited to different applications.

According to an exemplary embodiment of the invention there is disclosed a punching bag kit including a suspension line, a target having a fastening mechanism for suspending the target from the suspension line in a manner allowing the target to move along the suspension line, and a blocker for being positioned on the suspension line at a configurable distance from the target. The blocker is frictionally held in place on the suspension line at the configurable distance. Movement of the target along the suspension line is restricted upon the fastening mechanism of the target impacting the blocker. The blocker is physically larger than the fastening mechanism thus impeding travel of the fastening mechanism along the suspension line past the blocker.

According to an exemplary embodiment of the invention there is disclosed a punching bag system including a suspension line suspended between a plurality of mounting points, a target suspended from the suspension line using a fastening mechanism in a manner allowing the target to move along the suspension line, and a blocker positioned on the suspension line at a configurable distance from the target. The blocker is frictionally held in place on the suspension line at the configurable distance. Movement of the target along the suspension line is restricted upon the fastening mechanism of the target impacting the blocker. The blocker is physically larger than the fastening mechanism thus impeding travel of the fastening mechanism along the suspension line past the blocker.

These and other advantages and embodiments of the present invention will no doubt become apparent to those of ordinary skill in the art after reading the following detailed description of preferred embodiments illustrated in the various figures and drawings.

DETAILED DESCRIPTION

Brief Description of Exemplary Components

Figure 1A:
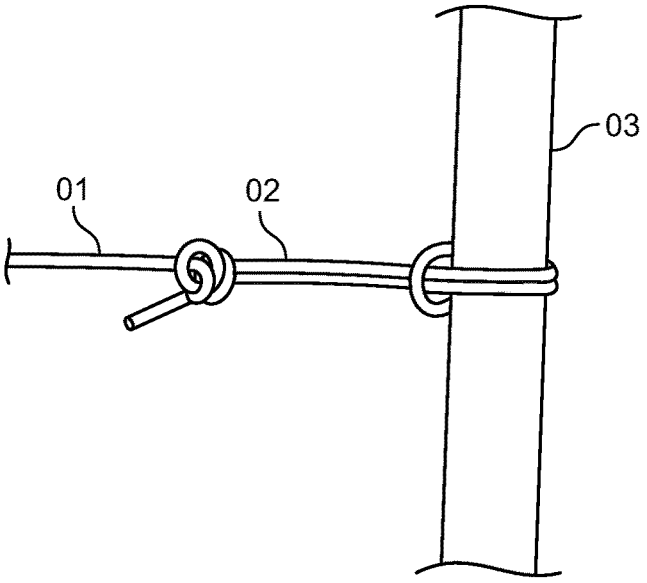
FIG. 1A shows a side perspective view of one end of a suspension line with a loop and a first method to affix the suspension line to a possible stationary object mount such as a post according to an exemplary embodiment.

1—Main suspension line (e.g., see FIGS. 1A and 1B), line component of punchline kit 49, looped end 2 to free end 4, where once tension is applied, line becomes taut and usable for activity.

2—Looped end of line 1 (e.g., see FIGS. 1A and 1B), initial securement section of punchline kit 49.

3—Quick mounts, also referred to as object mounts (e.g., see FIGS. 1A and 1B), suspension line 1 mountable object, found in many environments that can support the necessary load brought on by pulling the suspension line 1 tight, and keeping that tension maintained while in play, i.e., open/closed hooks placed into 2×4 wooden construction stud, posts, workout equipment frame, etc.

4—Free end of line 1 (e.g., see FIG. 2), section of suspension line 1, and is used to pull the line tight between the desired number of quick mounts 3 or base mounts 41, and is used to secure to line tension device 5 to maintain line tension for activity. The amount of free line is determined by the amount of distance needed for suspension line 1, and often varies.

5—Line tension device (e.g., see FIGS. 3 and 4), mechanism that is interactive with the suspension line 1 and the free end of line 4, placing along any part of suspension line 1 adjacent to target blockers 9 and removable targets 16, receives free end of line 4 and holds the tension for the suspension line 1.

6—Tension tab choke point (e.g., see FIGS. 3 and 4), area between line tension device 5 and suspension line 1, when line gets pulled, free end of line 4 is brought to opposing side of line tension device 5 and wedged initially into this point.

7—Tension tab holes (e.g., see FIGS. 3 and 4), holes placed into the line tension device 5 allows lateral movement along suspension line 1, when the line is under tension the placement of the holes holds the line tension device 5 more rigidly along the main suspension line 1.

8—Tension tab opposite choke (e.g., see FIG. 4), area of line tension device 5 opposite of tension tab choke point 6, after securing free end of line 4 to tension tab choke point 6 the free end of line 4 can be secured to the tension tab opposite choke 8 by laterally spinning the line tension device 5 180 degrees exposing the opposite side, the free end of line 4 can be brought around suspension line 1 snug to line tension device 5 and back to tension tab choke point 6 to hold adequate tension to suspension line 1.

9—Target blocker (e.g., see FIG. 5), mechanisms that are laterally interactive with the suspension line 1 and the free end of line 4, device used in pairs in some embodiments to maintain semi control of the removable targets 16 when removable targets 16 are secured to suspension line 1 between the two target blockers 9. The target blockers 9 which are larger in some dimension than the fastening mechanisms 17, 29, 33, 35 and 39 for the removable targets 16, and impede lateral movement past their selected positions on suspension line 1.

10—Target blocker draw cord (e.g., see FIG. 5), secures the target blockers 9 sturdy in place along the suspension line 1.

11—Target blocker draw cord notches (e.g., see FIG. 5), used to hold excess target blocker draw cord 10.

12—Target blocker draw cord holes (e.g., see FIG. 5), holds the target blocker draw cord 10, and positions it so it can secure to itself and to the suspension line 1.

13—Grommets (e.g., see FIG. 5), placed for reinforced hole strength in various positions.

14—Target blocker draw cord knot (e.g., see FIG. 5), knot placed on one end of target blocker draw cord 10 larger than target blocker draw cord holes 12 so free end of target blocker draw cord 10 can be pulled tight.

15—Target blocker draw cord choke (e.g., see FIG. 5), much like the tension tab choke point 6 the target blocker draw cord choke 15 has two points that the target blocker draw cord 10 can snug and cinch into, as to secure the target blockers 9 from moving during activity.

16—Removable target (e.g., see FIGS. 6, 7, 8, 9, 10), quickly connect to and disconnect from suspension line 1 via fastening mechanism 17, 29, 33, 35 and 39.

17—Carabiner clip (e.g., see FIG. 6), used to attach removable target 16 to suspension line 1. Connects to removable target 16 via grommet 13.

18—Carabiner gate (e.g., see FIG. 6), opens and closes into the carabiner 17 to connect to and disconnect from suspension line 1.

19—Target neck (e.g., see FIG. 6), adds varying lengths to removable target 16, also varying support material.

20—Target shoulder (e.g., see FIGS. 6, 7, 8, 9, 10), connects the target body 21, 26, 27, 31, 34 and 38, to the target neck 19 or connecting loop 28, or a two shouldered neck 25.

21—Medium target body (e.g., see FIG. 6), main striking area, varying densities, connects to target bottom 22, and target shoulder 20.

22—Target bottom (e.g., see FIGS. 6, 7, 8, 9, 10), located at bottom of removable target 16, closes the target body 21, 27, 31, 34 and 38, and adds a focus point to strike.

23—Removable target stitching (e.g., see FIGS. 6, 7, 8, 9, 10), hold the contents and materials of the removable target 16 together.

24—Focus pad (e.g., see FIGS. 7 and 10), external padding used on removable targets 16, to indicate optimal strike placement.

25—Link neck (e.g., see FIG. 7), connects two target bodies 26 and 27 together via target shoulder 20.

26—Upper target body (e.g., see FIG. 7), two target body bags upper target body 26, has two target shoulders 20, one for target neck 19 and link neck 25.

27—Lower target body (e.g., see FIG. 7), two target body bags lower target body 27, connects to link neck 25.

28—Link loop (e.g., see FIG. 7), connected to upper most portion of target neck 19 or shoulder 20, and holds link ring 30.

29—Free ring clip (e.g., see FIG. 7), connects onto suspension line 1 and removable target 16 with a mechanism that allows the ring to open and close.

30—Link ring (e.g., see FIG. 7), feed through link loop 28 and accepts the ring clip 29.

31—Large target body (e.g., see FIG. 8), main striking area, varying densities, connects to target bottom 22, and target shoulder 20.

32—Clip neck (e.g., see FIG. 8), same as target neck 19, attached to ring clip 33.

33—Ring clip (e.g., see FIG. 8), same as free ring clip 29 but physically attached to clip neck 32.

34—Small target body (e.g., see FIG. 9), main striking area, varying densities, connects to target bottom 22, and target shoulder 20.

35—Snap ring (e.g., see FIG. 9), similar to free ring clip 29, male/female snap mechanism holds ring closed.

36—Male snap (e.g., see FIG. 9), affixed to snap ring 35, used in conjunction with female snap 37 to hold snap ring 35 closed.

37—Female snap (e.g., see FIG. 9), affixed to snap ring 35, used in conjunction with male snap 36 to hold snap ring 35 closed.

38—Slim target body (e.g., see FIG. 10), main striking area, varying densities, connects to target bottom 22, and target shoulder 20.

39—Snap loop (e.g., see FIG. 10), connects to target neck 19 male/female snaps 40, open and close the loop, allowing connection to suspension line 1.

40—Male/female snaps (e.g., see FIG. 10) affixed to snap loop, opens and closes snap loop 39.

41—Base mount (e.g., see FIG. 11), affixes to wooden construction studs in home/gym walls or alternate construction material, via support anchor screws/screw port 42, mechanical or electronic component 47 used to engage height adjustment mechanism 44 raising or lowering connected punchline kit 49.

42—Support anchor screws/screw port (e.g., see FIG. 11), affixes base mount 41 to available supporting wall.

43—Top mount, (e.g., see FIG. 11) allows the rotational motion of hitching post 44 clasping the upper most section of hitching post 44.

44—Hitching post formed by a helical screw system (e.g., see FIG. 11), mechanism on base mount 41 used for main support assistance as well as to raise or lower the height of the connected punchline kit 49.

45—Mount frame (e.g., see FIG. 11), main structure support for all working components of base mount 41.

46—Seat mount (e.g., see FIG. 11), seats the weight of the hitching post 44 holding and engaging rotational motion to hitching post 44 from mechanical or electronic gearbox 47.

47—Mechanical or electronic gearbox (e.g., see FIG. 11), provides method either mechanical or electronic that engages rotational force used to turn hitching post 44 raising or lowering punchline kit 49.

48—General user placement (e.g., see FIG. 12), standing underneath or to the side, wherever strike distance allows.

49—The punchline kit, also referred to as the punching bag kit (e.g., see FIG. 13), various working line components of the present invention according to an exemplary embodiment.

BRIEF DESCRIPTION OF EXEMPLARY EMBODIMENTS

A punching bag system and guidelines to install the punching bag system using a punching bag kit are described with reference to the figures.

FIG. 1A shows a side perspective view of a method for connecting a two-ended suspension line 1 to a point in a physical environment where the punching bag system would be set up using the components of the punching bag kit. In FIG. 1A, the suspension line 1 is connected to an object mount 3 at a user-desired height using a looped end 2 of the suspension line 1. In this embodiment, the object mount 3 is a post or similar stationary structure already present in the physical environment. The looped end 2 is wrapped once around the post 3 at the user-desired height and then the suspension line 1 is passed through a loop present in the looped end 2. The suspension line 1 is then pulled tight, resulting in a secure attachment of the looped end 2 to the post 3.

Figure 1B:
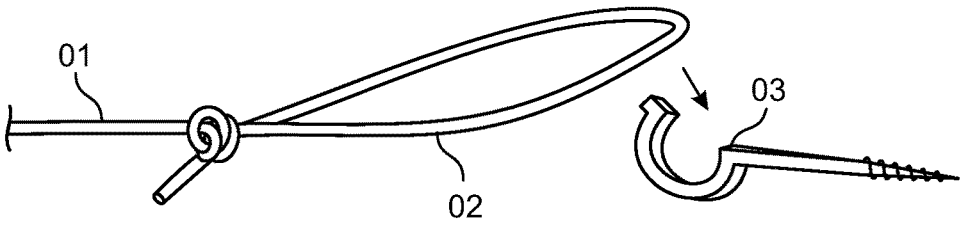
FIG. 1B shows a side perspective view of one end of a suspension line with a loop and another method to affix the suspension line to a possible stationary object mount such as a hook according to an exemplary embodiment.

FIG. 1B shows another embodiment where the object mount 3 is a hook affixed to a rigid surface such as a wall or stud within a wall (not shown in the figure) at the user-desired height. The looped end 2 of the suspension line 1 is slipped through the hook 3 thereby attaching the suspension line 1 to the surface to which the hook 3 is affixed.

Figure 2:
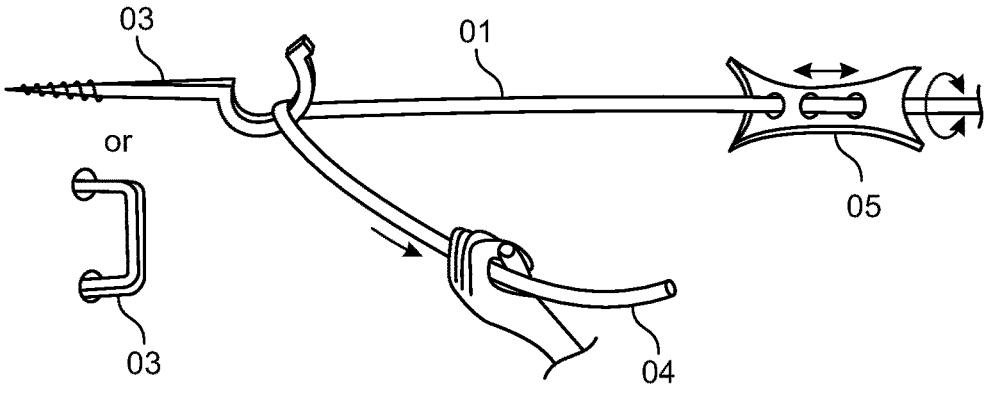
FIG. 2 shows a side perspective view of free end of suspension line and methods to affix to possible stationary object mounts with line tension device in ready position to secure suspension line tension according to an exemplary embodiment.

FIG. 2 illustrates a method to connect a free end 4 of the suspension line 1 to a point in the physical environment where the punching bag system is set up. The suspension line 1 has an end referred to as the free end 4. The free end 4 and the looped end 2 constitute the two ends of the suspension line 1. The free end 4 is connected to either the object mount 3 or a base mount 41 which are affixed to the point at the user-desired height from floor and user-desired distance. In this embodiment illustrated in FIG. 2, the free end 4 is connected to the object mount 3 which is a hook similar to the hook used to connect to the looped end 2 in FIG. 1B. However, the method of connecting to the object mount 3 is different here. In this case, the free end 4 of the suspension line 1 is passed through the object mount 3 without fixing the free end 4 to the object mount 3 as illustrated in FIG. 2. This ensures that the suspension line 1 is suspended at the desired height and distance while leaving the free end 4 free to connect to additional points. The free end 4 is connected in a similar manner through object mounts 3 or base mounts 41 affixed to as many points as required and then secured to a last object mount 3 or base mount 41 using a line tension device 5 that is shown here supported on the suspension line 1. The line tension device 5 can be mounted on any section of the suspension line 1 before the last object mount 3 or base mount 41 through which the free end 4 is passed. In some embodiments, the suspension line 1 is connected between two points spaced apart in the physical environment, the looped end 2 attached to one point and the free end 4 attached to the other point. The two points may be at the same height or at different heights based on user requirement.

Considering the general case of the suspension line 1 connected to a plurality of points which includes embodiments with two points as a particular case, the suspension line 1 is pulled tight between all the points through which it is passed and then the free end 4 that is connected through the final object mount 3 or base mount 41 is attached to the line tension device 5 that is mounted on the suspension line 1. The line tension device 5 is used to adjust and maintain the tension in the suspension line 1 using the free end 4 of the suspension line 1 attached to it.

Figure 3:
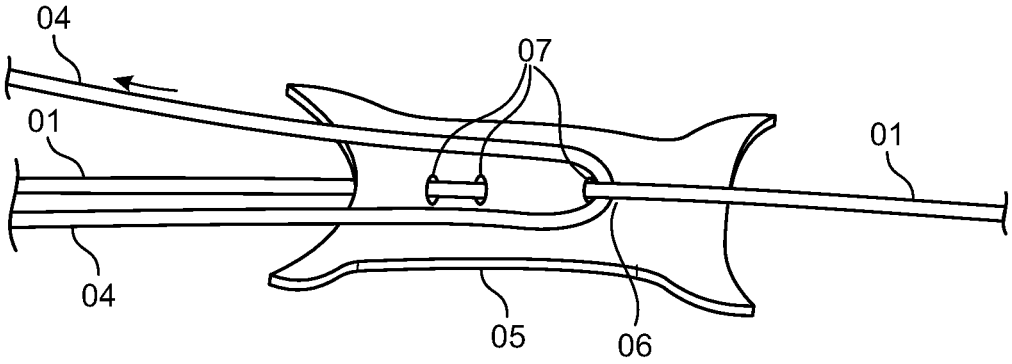
FIG. 3 shows a side perspective view of line tension device in position on a suspension line detailing how the free end of the suspension line initially secures into tension tab choke point according to an exemplary embodiment.
Figure 4:
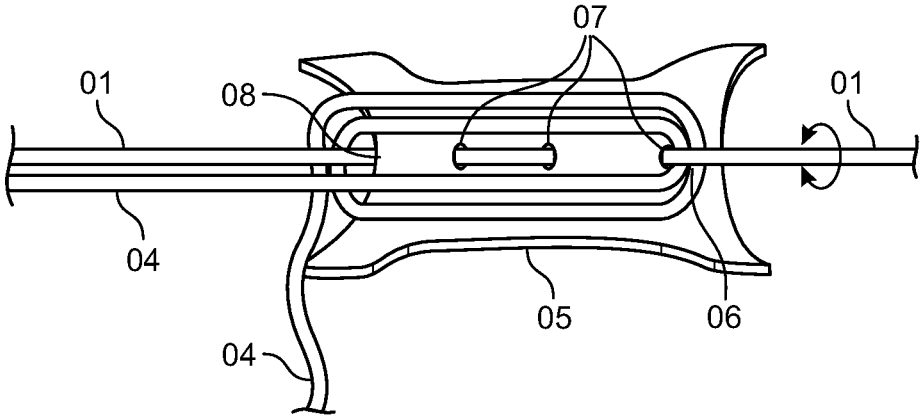
FIG. 4 shows a side perspective view of line tension device in position on suspension line detailing how the free end of suspension line secures into tension tab choke point and tension tab opposite choke, holding line tension according to an exemplary embodiment.

FIG. 3 and FIG. 4 illustrate how the free end 4 is attached to the line tension device 5. In this embodiment, the line tension device 5 comprises a flat piece of material with three coplanar holes referred to as tension tab holes 7 through which the suspension line 1 passes in a weaving manner as shown in FIGS. 2-4. The suspension line 1 enters a first tension tab hole 7 of the line tension device 5 at a point referred to here as tension tab choke point 6, passes through a second tension tab hole 7 and exits the line tension device 5 through a last tension tab hole 7. The region of the line tension device longitudinally across and opposite to the tension tab choke point 6 is referred to as tension tab opposite choke 8.

The free end 4 of the suspension line 1, after passing through the last object mount 3, is pulled back towards the line tension device 5 and brought to the choke point 6 where it is wedged under the suspension line 1 entering the tension tab hole 7 as shown in FIG. 3. The free end 4 is then looped back along the line tension device 5 toward the opposite choke 8 where it is passed over and across the suspension line 1 that is exiting the last tension tab hole 7, such that the suspension line 1 gets wedged between the free end 4 and the line tension device 5 as shown in FIG. 4. The free end 4 is again looped back along the line tension device 5 on the same side as earlier, towards the choke point 6 thus forming a full loop of the suspension line 1 on one face of the line tension device 5. The free end 4 of the suspension line 1 is wound tightly on the line tension device 5 in this manner as many times as necessary, with the entry/exit points of the suspension line 1 passing through the first and last tension tab holes 7 serving as anchor points, and the winding snugly enclosing the section of the suspension line 1 passing through the tension tab holes 7 of the line tension device 5 as illustrated in FIG. 4. This arrangement helps to maintain the tension in the suspension line 1 at the required level due to the frictional force preventing slippage of the suspension line 1 that is wound across the section of the suspension line 1 that is passed through the tension tab holes 7.

Figure 16:
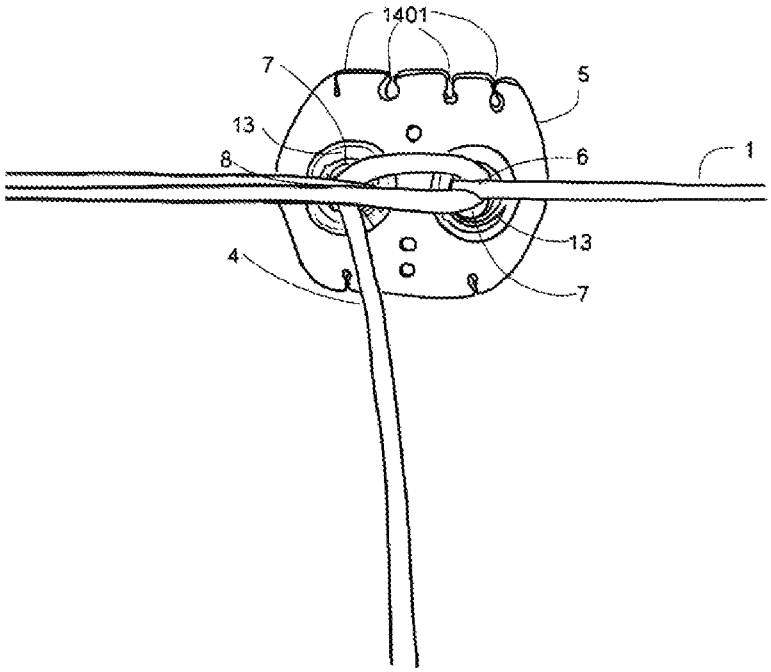
FIG. 16 shows a close-up view of the line tension device of FIG. 14 while the friction of the suspension line against itself at a choke point is holding the tension in the line at a constant level according to an exemplary embodiment.
Figure 17:
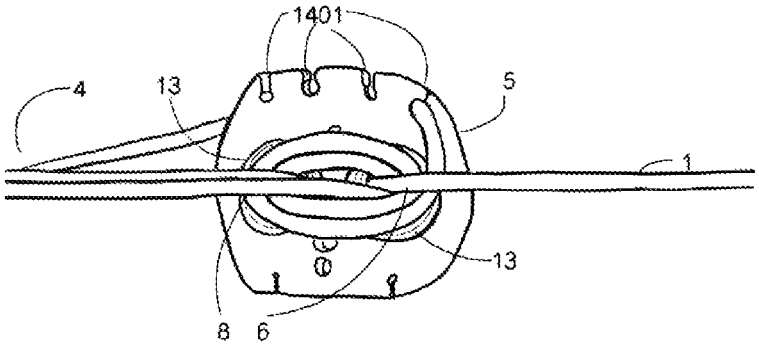
FIG. 17 illustrates a close-up view of the line tension device of FIG. 14 after the suspension line is wrapped a plurality of times around the choke points to increase friction and then the free end of the line is secured in a groove according to an exemplary embodiment.

FIGS. 14-17 illustrate the line tension device 5 with a different structure according to an exemplary embodiment. In this embodiment, the line tension device 5 comprises two tension tab holes 7 each lined with a grommet 13 for reinforced hole strength. The line tension device 5 is mounted on the suspension line 1 by passing the suspension line 1 through the two tension tab holes 7. The line tension device 5 further comprises a set of grooves 1401 cut into the upper and lower edges of the line tension device 5, where upper and lower are defined with respect to the suspension line 1 transverse to the direction in which the suspension line 1 enters and exits the line tension device 5 through the two tension tab holes 7. The free end 4 of the suspension line 1 is wound on one face of the line tension device 5 using the tension tab choke point 6 and the opposite choke 8 as anchor points in the manner described earlier and illustrated in FIGS. 14-17. After the free end 4 of the suspension line 1 is wound on the line tension device 5 as many times as necessary, the free end 4 is slotted into one or more grooves of the set of grooves 1401 of the line tension device 5 as shown in FIG. 16. In some embodiments the grooves 1401 have a width less than the thickness of the suspension line 1. When the free end 4 of the suspension line 1 is compressed in the aspect of thickness and slotted or squeezed into one or more of the set of grooves 1401, it is frictionally held in the grooves 1401, thereby preventing unintended slippage or unwrapping of the suspension line 1 from the line tension device 5.

The free end 4 of the suspension line 1 that exits the line tension device 5 is left hanging freely from the line tension device 5 as shown in FIG. 16 to allow quick and easy adjustments to the tension in the suspension line 1. The tension in the suspension line 1 can be easily adjusted by unwinding the free end 4 from the line tension device 5 and pulling the free end 4 tighter or releasing it a little to make it looser in order to increase or decrease the tension in the suspension line 1 respectively. The free end 4 is then wound again on to the line tension device 5 as before, making sure to maintain the newly configured line tension while winding.

Figure 5:
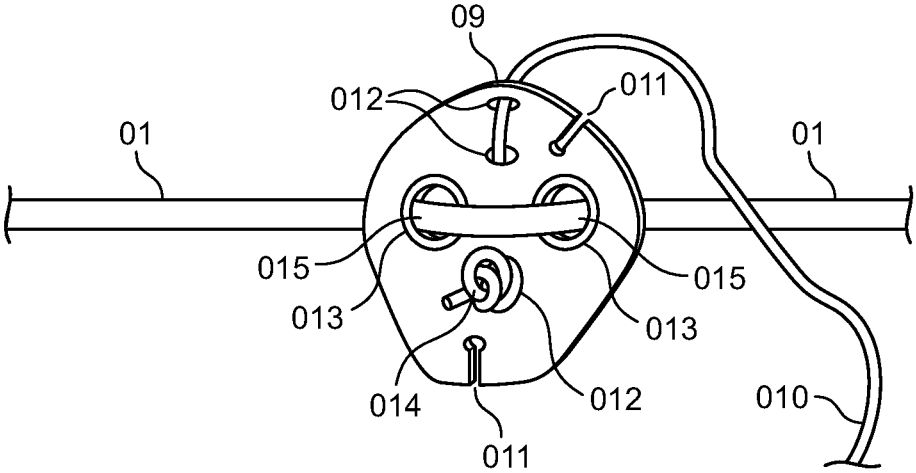
FIG. 5 shows a side perspective view of a target blocker in random lateral position on suspension line and working components therein according to an exemplary embodiment.
Figure 6:
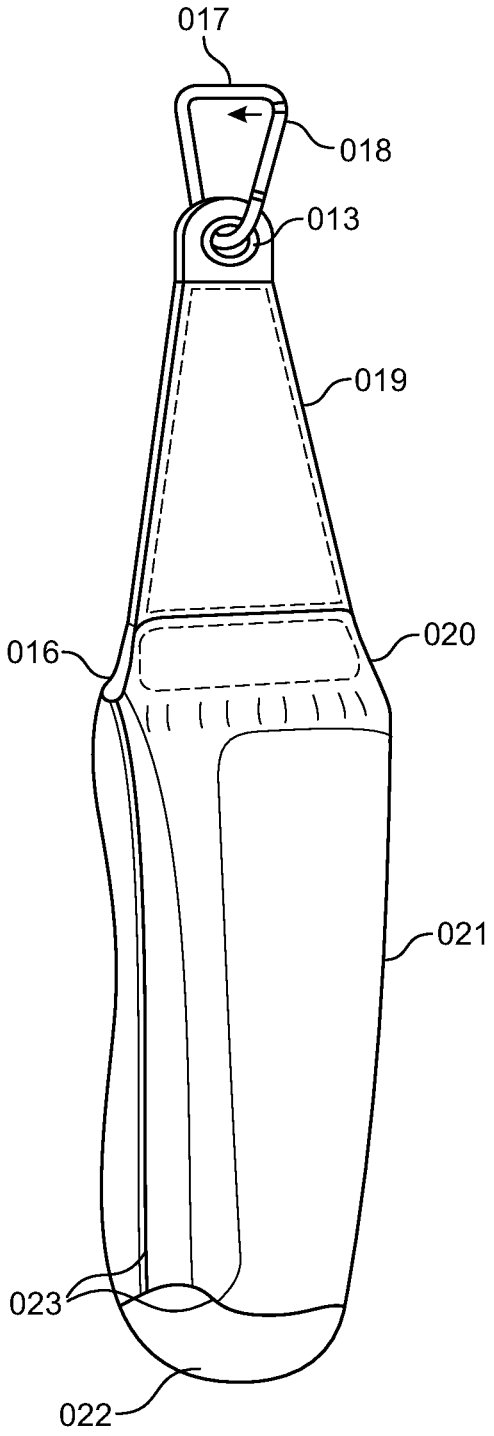
FIG. 6 shows a side perspective view of removable target with medium target body using a method of attachment being a carabiner clip and other working components therein according to an exemplary embodiment.

FIG. 5 illustrates a target blocker 9 mounted on the suspension line 1 to restrict the lateral movement of a punching target 16, such as the one illustrated in FIG. 6, along the suspension line 1. In this embodiment, similar to the tension device 5, the blocker 9 comprises a flat piece of material with two blocker holes lined with grommets 13 for reinforced hole strength. The blocker 9 is mounted on the suspension line 1 by passing the suspension line through the blocker holes. Generally, two blockers 9 would be used for each target 16, one blocker 9 placed on either side of the target 16 suspended on the suspension line 1. In this embodiment, the blocker 9 is held in place on the suspension line 1 using a blocker draw cord 10 shown in FIG. 5. The blocker 9 further comprises draw cord holes 12 that are placed transverse to the blocker holes. The blocker draw cord 10 is passed through two draw cord holes 12 and then passed through a final draw cord hole 12. The end of the draw cord 10 out of the final draw cord hole 12 is tied into a knot 14 that is larger in size than the final draw cord hole 12. This is to ensure that the draw cord 10 remains attached to the blocker 9 while the other end of the draw cord 10, which is the free end, is pulled tight.

Similar to the line tension device 5, the blocker 9 features draw cord choke points 15 at the regions where the suspension line 1 enters and exits the blocker 9 through the blocker holes. The blocker is frictionally held in place on the suspension line 1 using the draw cord 10 and the choke points 15. The choke points 15 serve as anchor points where the draw cord 10 is wound around the segment of the suspension line 1 present within the blocker 9.

In some embodiments, the free end of the draw cord 10 is pulled tight and then brought to one of the choke points 15 and wedged under the suspension line 1 as it enters/exits the blocker hole. The draw cord 10 is then turned around and brought to the second choke point 15 situated on the opposite end of the blocker 9 while running the cord parallel to the line containing the blocker holes. The draw cord 10 is run along the same face of the blocker 9 where the draw cord 10 was wedged at the first choke point 15. The draw cord 10 is then looped around the second choke point 15 by again wedging the draw cord 10 under the suspension line 1 as it enters/exits the blocker hole. The draw cord 10 is brought back to the first choke point 15 parallel to the previous path forming a complete loop. The draw cord 10 is again wedged under the suspension line 1 at the first choke point 15 and the process is repeated, thus winding the draw cord 10 around the choke points 15. The length of draw cord 10 remaining after winding on the blocker 9 as many times as needed, is stuck into the draw cord notch 11 to ensure that the draw cord 10 remains wound. The draw cord 10 is frictionally held in the cord notch 11 that has a width less than the thickness of the draw cord 10, thereby preventing unintended slippage or unwrapping of the draw cord 10 from the blocker 9. The frictional force between the loop of draw cord 10 and the suspension line 1 entering/exiting the blocker holes serves to hold the blocker 9 in place on the suspension line 1.

Figure 18:
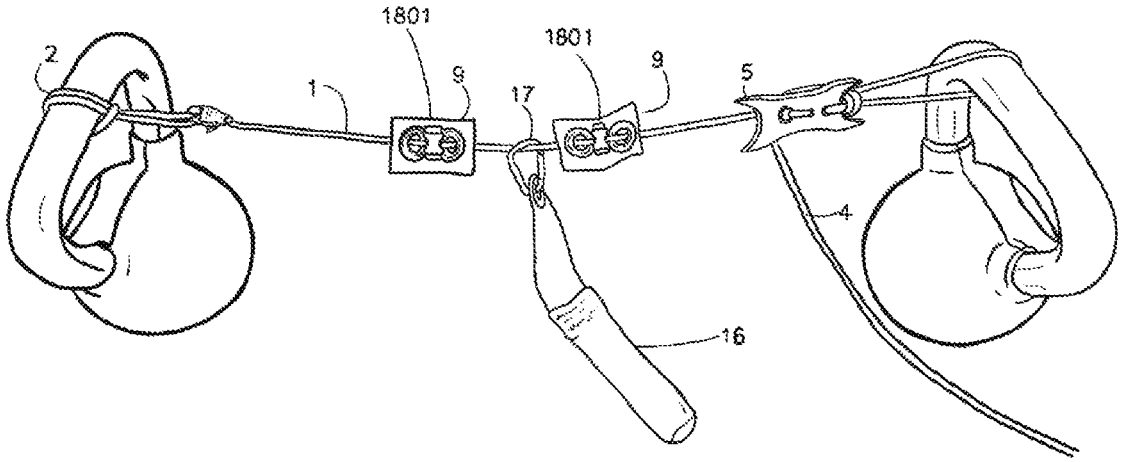
FIG. 18 illustrates how the target is suspended from the suspension line and has a free range of motion along the suspension line between two blockers according to an exemplary embodiment.
Figure 19:
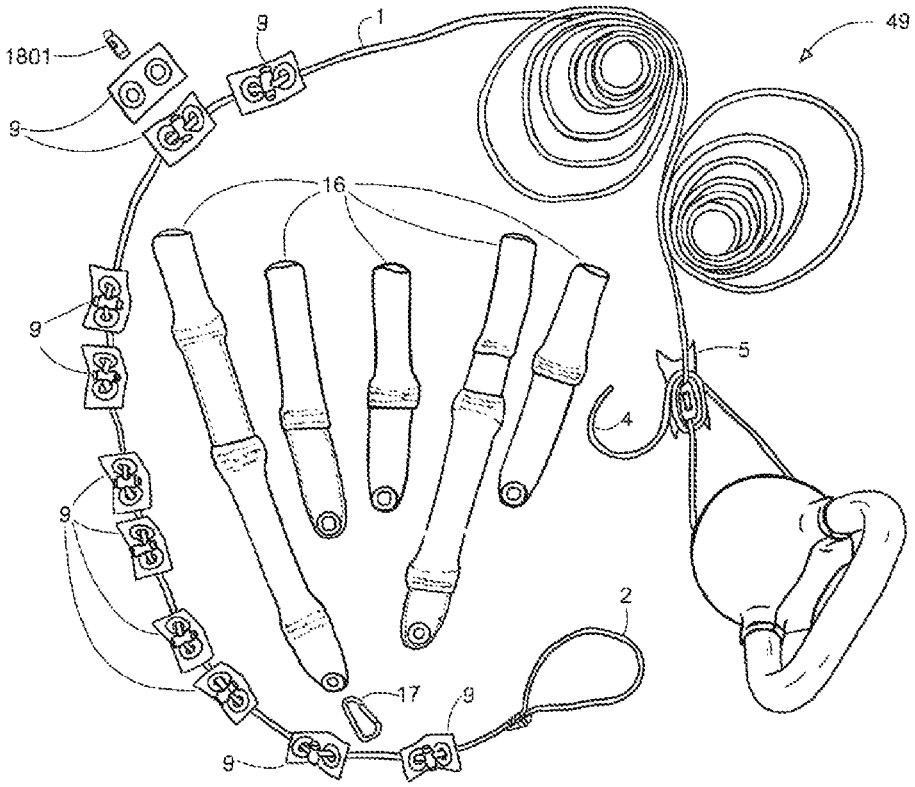
FIG. 19 illustrates components of a punching bag kit according to an exemplary embodiment.
Figure 20:
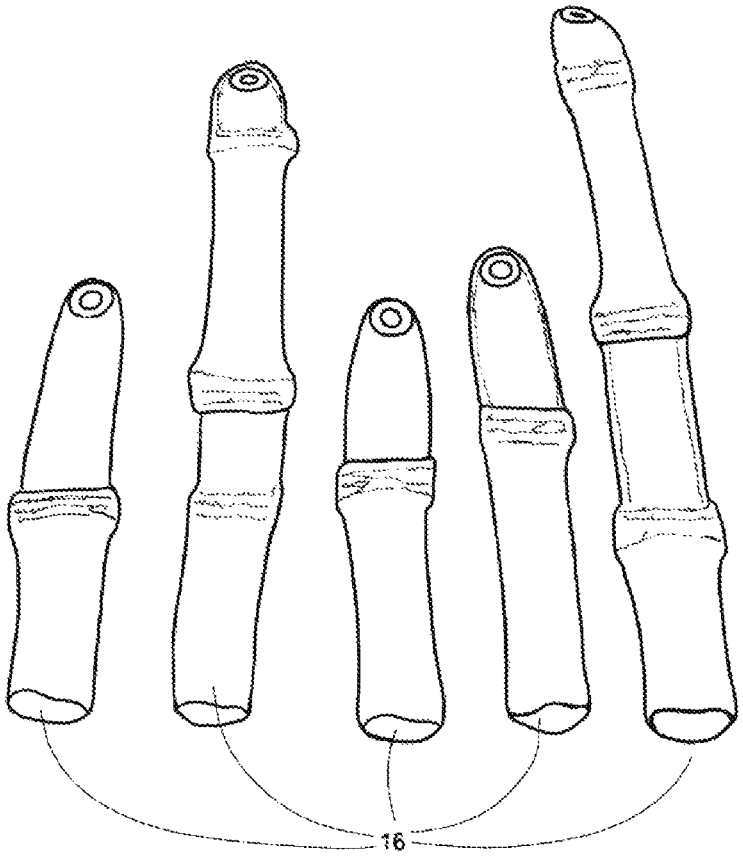
FIG. 20 illustrates a close-up view of five different types of targets of the kit of FIG. 19 according to an exemplary embodiment.

FIG. 18 illustrates another embodiment of the blocker 9 with two of the blockers 9 mounted on the suspension line 1, one on each side of the target 16 that is suspended from the suspension line 1 using a carabiner clip 17 as the fastening mechanism. In this embodiment, the blocker 9 is a rectangular, flat but flexible structure with two blocker holes lined with grommets 13 for the suspension line 1 to pass through. The blocker 9 shown in FIG. 18 is different from the blocker 9 shown in FIG. 5 earlier, in terms of the mechanism used to hold the blocker in place on the suspension line 1. Here, the blocker 9 does not have a draw cord 10 and associated structures. Instead, there is a spring-loaded cord lock 1801 mounted on the suspension line 1 in between the two blocker holes. A cord lock 1801 is shown separate from a blocker 9 in FIG. 19.

The cord lock 1801 has a hole or aperture that becomes large enough for the suspension line 1 to pass through when the spring of the cord lock 1801 is compressed by applying pressure. The suspension line 1 is first passed through the first blocker hole, then passed through the aperture of the cord lock 1801 while keeping the spring compressed, and it is then passed through the second blocker hole. When the spring of the cord lock 1801 is released by removing the applied pressure, the suspension line 1 passing through the aperture of the cord lock experiences the recoil force of the spring and is jammed in place, and as a result the cord lock cannot move easily along the suspension line due to friction between the suspension line and the walls of the aperture of the cord lock. The cord lock 1801 can be moved again along the suspension line 1 by compressing the spring thereby releasing the suspension line 1 or by applying a force greater in magnitude than the frictional force holding the cord lock 1801 in place. The length of the cord lock 1801 in a dimension transverse to the suspension line 1 is greater than the diameter of the blocker holes, thereby ensuring that the cord lock 1801 cannot be passed through the blocker holes unless it is forcibly tilted at an extreme angle. Hence, for all practical purposes the cord lock 1801 and the blocker 9 can be treated as a single unit when they are mounted on the suspension line in the manner described above. Thus, the cord lock 1801, and by extension the blocker 9, are frictionally held in place on the suspension line 1 by the clamping force of the spring present in the cord lock 1801 on the suspension line 1 passing through the hole of the cord lock 1801.

A function of the blocker 9 is to restrict the lateral movement of the target 16 along the suspension line 1. It accomplishes this by presenting a physical barrier to the target 16 travelling along the suspension line 1 as a result of being struck by the user. The blocker 9 presents a firm barrier to the target 16 since it is held in place on the suspension line 1 by the mechanisms described earlier. Moreover, the blocker 9 is designed to be physically larger than the aperture present in the fastening mechanisms of the target 16 so that the fastening mechanism and hence the target 16 cannot pass by or over the blocker on the suspension line 1 without the blocker being significantly deformed. In some embodiments, the blockers are made of a deformable material such as leather or nylon and it is possible for the fastening mechanism to get by the block, but only if significant force is imparted such that the blocker is "squished" through the aperture of the fastening mechanism. In some embodiments, two blockers are suspended on the suspension line 1 for every target suspended on the suspension line; one blocker on each side of the target. The position of the two blockers on either side of the target 16 determines the allowed range of motion for the target. The distance between the blockers 9 define a target movement range within which the target 16 can freely move along the suspension line 1 before impacting a blocker 9 and being impeded from further movement in the same direction.

FIG. 6 illustrates a target 16 along with its fastening mechanism in one of several embodiments. In this embodiment, the target 16 is a compact punching bag which comprises a medium target body 21 which is the main striking area of the target 16, a target neck 19, a target shoulder 20, a target bottom 22, and target stitching 23. The target stitching 23 holds together the content of the target body and is used to attach the shoulder 20, neck 19 and bottom 22 to the target body 21 to form the target 16. The target shoulder 20 is a segment of the target 16 that connects the upper portion of the medium target body 21 to the target neck 19. The target neck 19 in turn is connected to the fastening mechanism, wherein the fastening mechanism enables the target to be suspended from the suspension line 1. Since the target neck 19 is available in the punching bag kit 49 in some embodiments with various lengths, the length of the target 16 can be customized based on user preference. The region of the target neck 19 where it connects with the fastening mechanism varies in structure depending upon the fastening mechanism in use. In this embodiment, the fastening mechanism is a carabiner clip 17 equipped with a carabiner gate 18. The carabiner clip 17 has an aperture large enough to accommodate the thickness of the suspension line 1. The carabiner gate 18 opens and closes with a spring action into the aperture of the carabiner clip 17, with the opening being wide enough for the thickness of the suspension line 1 to pass through. Consequently, the carabiner clip 17 can be connected and disconnected from the suspension line 1 without requiring an end of the suspension line to pass through the aperture of the carabiner clip 17. Hence, the target 16 can be connected and disconnected at any point on the suspension line 1 while the suspension line 1 remains suspended.

As illustrated in FIG. 6, the target neck 19 has a hole with a grommet 13 to accommodate linkage with the carabiner clip 17. The carabiner clip 17 can be easily attached and detached from the target neck 19 in a manner similar to the connection of the carabiner clip 17 with the suspension line 1 since the principle is the same. This allows the user to effortlessly and quickly switch multiple targets 16 suspended on the suspension line 1 using the same fastening mechanism connected to the suspension line 1. Further, since the fastening mechanism, which is a carabiner clip 17 in this embodiment, has an aperture through which the suspension line 1 passes wherein the frictional force between the carabiner clip 17 and the suspension line 1 at the point of contact is substantially small, the fastening mechanism and hence the target 16 attached to it are free to perform swinging motion in any direction when the target 16 is struck by the user, while the target 16 remains suspended from the suspension line 1. Hence, in some embodiments where the fastening mechanism has an aperture, the target 16 can swing freely in any plane around the suspension line 1 based on the force imparted by the user. This results in 360 degree all round movement capacity for the target thereby enabling additional training modes for the user.

Figure 7:
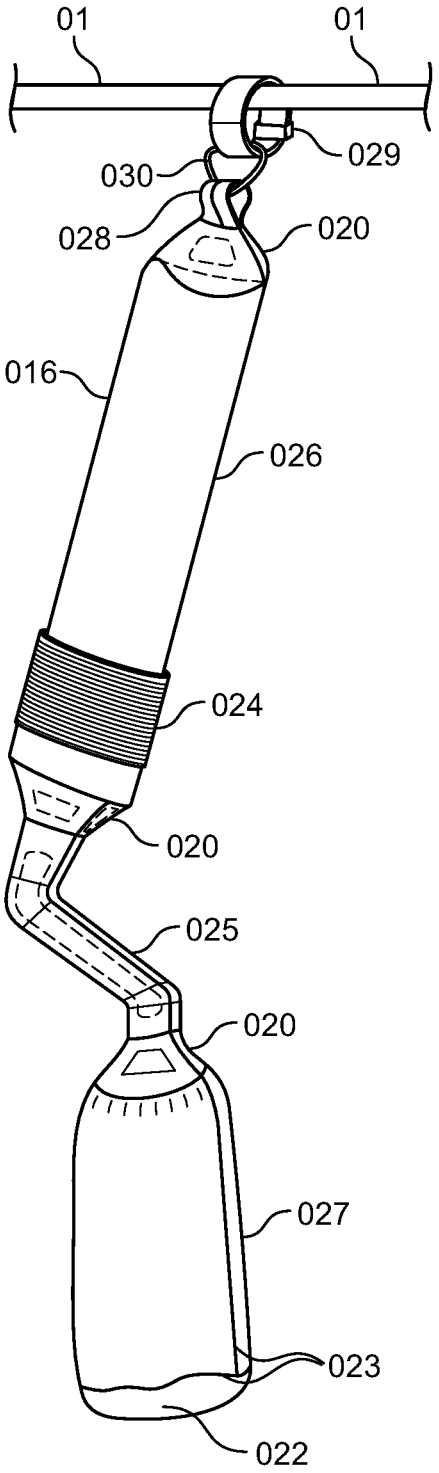
FIG. 7 shows a side perspective view of removable target secured along suspension line with two target bodies using alternate method of attachment (ring), and other working components therein according to an exemplary embodiment.

FIG. 7 shows another embodiment of the target 16 which has two target bodies, an upper target body 26 and a lower target body 27 linked together using a link neck 25. A single target shoulder 20 is present on the upper portion of the lower target body 27, while the upper target body 26 has two target shoulders 20, one on its lower part and one on its upper part. The link neck 25 connects the shoulder 20 present on the lower part of upper target body 26 with the shoulder 20 present on the upper part of the lower target body 27. An alternative embodiment of the fastening mechanism is shown in FIG. 7. The fastening mechanism is a free ring clip 29 that has an aperture large enough to accommodate the thickness of the suspension line 1 and a mechanism to open and close the ring to connect to the suspension line. The mechanism to open and close the ring may include a slit such that the ends of the ring that meet at the slit can be pulled apart by a user in order to create an opening. In another embodiment, the opening mechanism may include a hinge to make it easier to open two parts of the ring by rotating the parts around the hinge.

The free ring clip 29 is connected to a link ring 30 whose purpose is to provide a linkage between the free ring clip 29 and the link loop 28 that is attached to the target shoulder 20 (or to an additional target neck 19 as illustrated in FIG. 6) of the upper target body 26. The link loop 28 performs a function similar to the hole with grommet 13 in the target neck 19 of FIG. 6.

Figure 8:
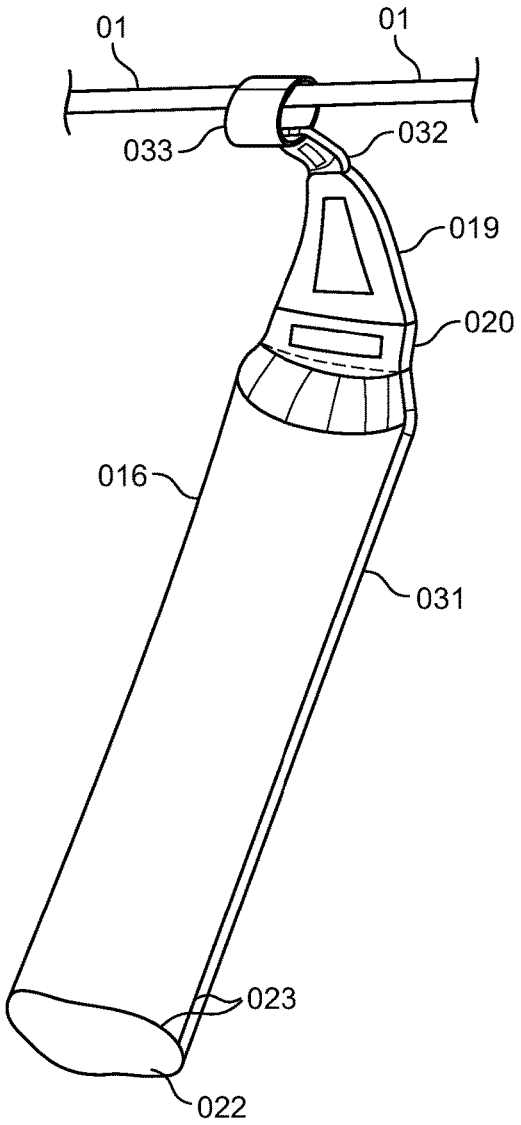
FIG. 8 shows a side perspective view of removable target secured along suspension line with large target body using alternate method of attachment (ring), and other working components therein according to an exemplary embodiment.

FIG. 8 illustrates another embodiment of the target 16 with a large target body 31 as its main striking area. The fastening mechanism shown here is a ring clip 33 similar to the free ring clip 29 of FIG. 7. The difference between the two fastening mechanisms is that the ring clip 33 is permanently attached to a clip neck 32 that is attached to the target neck 19 of the large target body 31. In effect, the fastening mechanism used in this embodiment remains attached to the target 16 and can be connected to and disconnected from the suspension line 1 as needed. Other aspects of the target 16 remain similar to the embodiments shown in FIG. 6 and FIG. 7. The large target body 31 has a target shoulder 20 on its upper side that is attached to the target neck 19 and a target bottom 22 on its lower side.

Figure 9:
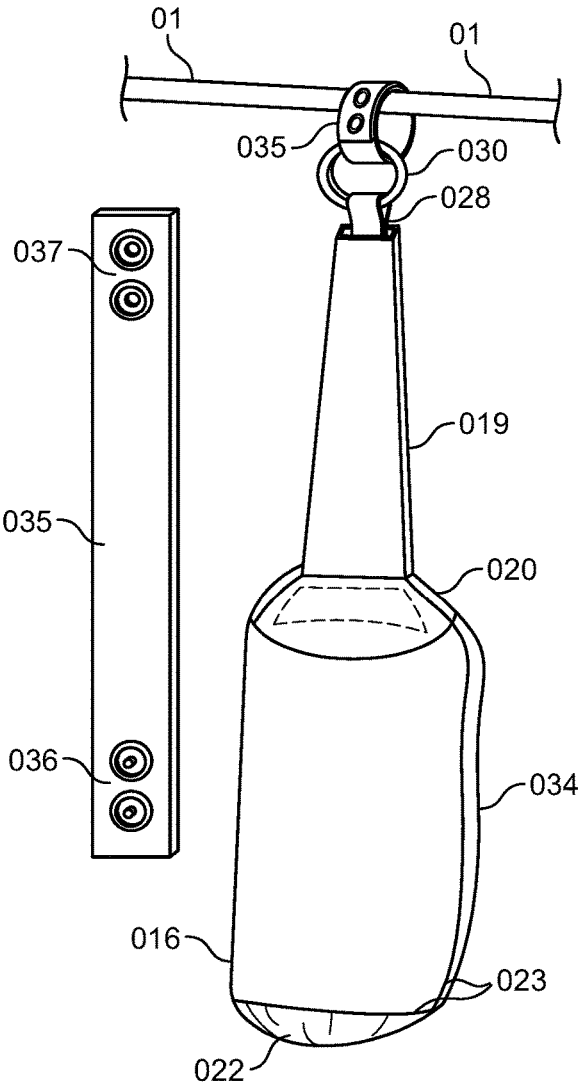
FIG. 9 shows a side perspective view of removable target secured along suspension line with small target body using alternate method of attachment (strap), and other working components therein according to an exemplary embodiment.

FIG. 9 illustrates another embodiment with a small target body 34 as the striking area and a snap ring 35 as the fastening mechanism to connect the target 16 to the suspension line 1. The snap ring 35 is a flexible band or strip with a set of male snaps 36 on one end and female snaps 37 on the other end of the strip as shown in FIG. 9. The male snaps 36 and the female snaps 37 snap together securely to form a closed loop. The open snap ring 35 is folded into a loop around the suspension line 1 and the snaps closed in order to connect the attached target 16 to the suspension line 1. The snaps are opened in order to open the snap ring 35 and disconnect the target 16 from the suspension line 1. The link ring 30 is again used here to provide linkage between the fastening mechanism viz. the snap ring 35 and the link loop 28 attached to the target neck 19.

Figure 10:
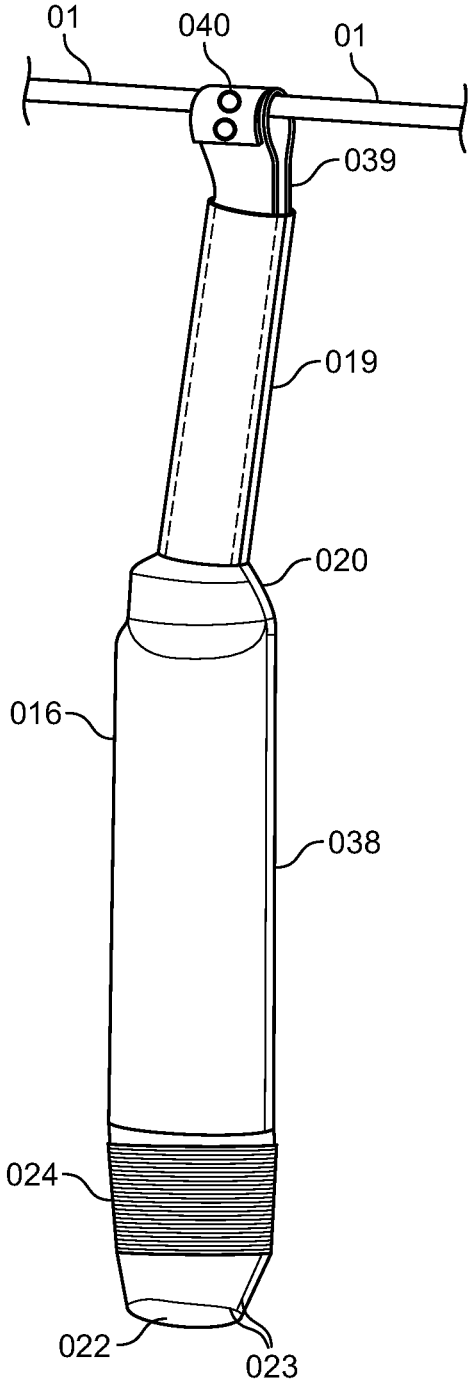
FIG. 10 shows a side perspective view of removable target secured along suspension line with slim target body using alternate method of attachment (strap), and other working components therein according to an exemplary embodiment.

Another embodiment of the target 16 with a slim striking area referred to as slim target body 38 is illustrated in FIG. 10. The fastening mechanism shown is a snap loop 39 that is similar to the snap ring 35 of FIG. 9, with the difference being that the snap loop 39 is attached directly to the target neck 19 instead of being attached through a link ring 30 and a link loop 28 to the target neck 19 as in the case of the snap ring in FIG. 9. The snap loop 39 is opened and closed using male and female snaps 40 similar to those on the snap ring 35 in FIG. 9.

Figure 11:
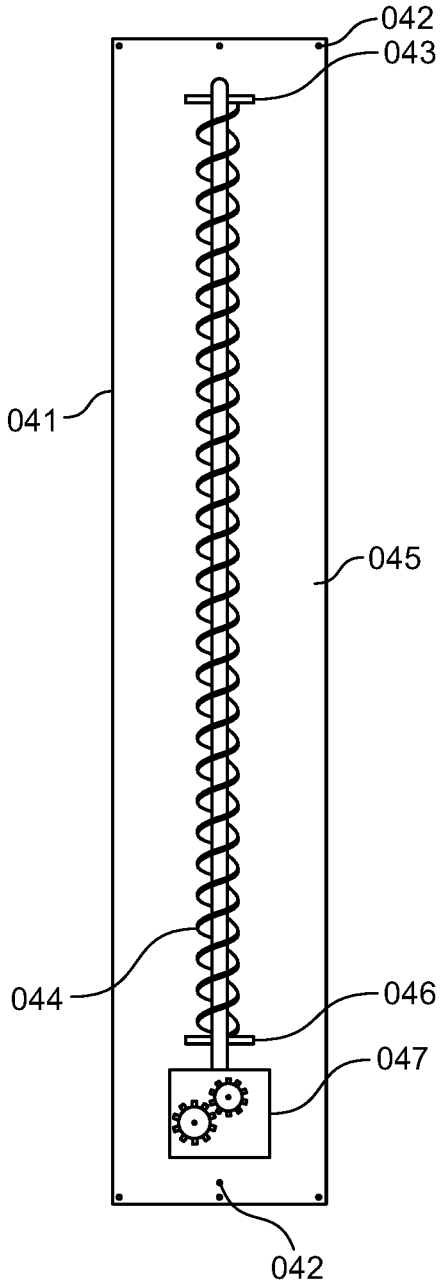
FIG. 11 shows a front facing perspective view of base mount and other working components therein according to an exemplary embodiment.

FIG. 11 illustrates a base mount 41 that can be used to securely connect the suspension line 1 to a vertical surface such as a wall. The base mount 41 can be used as an alternative to or in conjunction with the object mount 3 to suspend the suspension line 1 at a user-desired height. The advantage of the base mount 41 over the object mount 3 is that it has a provision to adjust the height of the connected suspension line 1 without having to disconnect it; whereas for the object mount 3, the suspension line 1 has to be either disconnected from the object mount 3 or the line tension has to be reduced to loosen the suspension line 1 in order to adjust the height.

In this embodiment, the base mount 41 is affixed to a stable, stationary vertical surface using support anchor screws and screw ports 42. It comprises a mount frame 43 which is the main structure of the base mount 41 supporting all the other components, a helical screw system 44 to which the suspension line 1 is connected, a top mount 43 which is connected to the upper most section of the helical screw system 44, a seat mount 46 connected to the bottom portion of the helical screw system 44 and a gear box 47 that can be mechanical or electronic. In operation, the looped end 2 or the free end 4 of the suspension line 1 that is connected to the base mount 41 is moved upwards or downwards by the helical screw threads of the system 44 rotating in first and second directions. The gear box 47 may be driven manually by a user turning a crank or may include a motor or other actuator to automatically turn the screw system 44.

Figure 12:
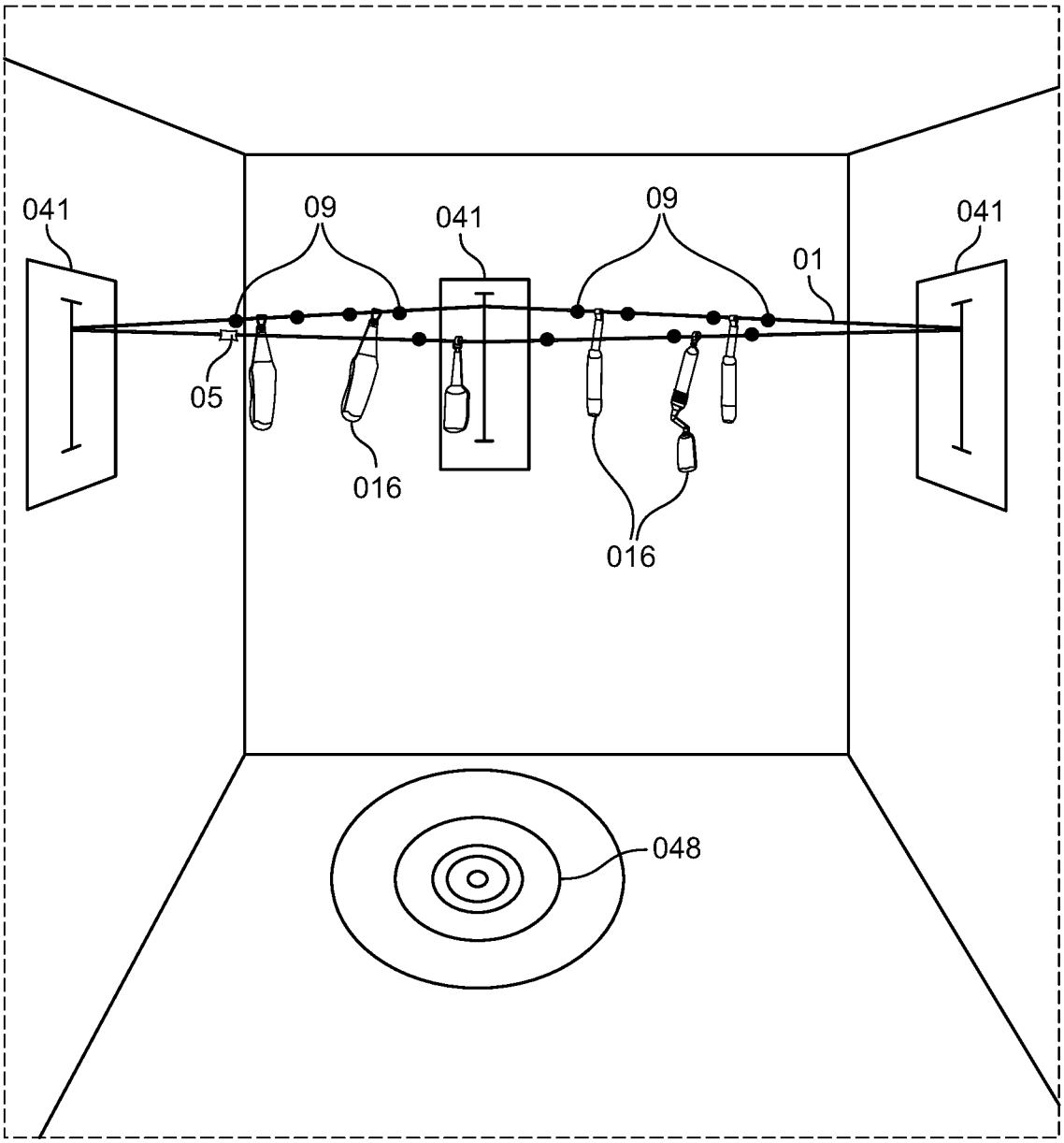
FIG. 12 shows a side perspective view of the punching bag system in full with three base mounts, offering 360 degree target placement while user stands in general user placement of six user-defined removable targets each of which is contained by two target blockers, and line tension device holding the required line tension, in one of many possible scenarios in an enclosed room according to an exemplary embodiment.

FIG. 12 illustrates an exemplary embodiment of a punching bag system that is set up in a physical environment using the components of the punching bag kit 49. The system comprises a suspension line 1 suspended between three vertical surfaces (i.e., walls) using a base mount 41 affixed to each vertical surface. The suspension line 1 forms a closed loop structure with three segments. This is a specific case of the general case described earlier. Each segment can have the height of its mounting points, which are the points of attachment with the base mounts, dynamically adjusted such that the segment can be at a different height and slope. Beneficially, the height of the suspension line 1 connected to each base mount 41 can be adjusted independently as per user requirements. In this embodiment, six targets 16 have been suspended from the suspension line 1 with different types of target body sizes and configurations described earlier. There are twelve target blockers 9 mounted on the suspension line 1, two blockers 9 per target 16 with one blocker 9 on each side of the target 16 at a user-configured distance. A line tension device 5 is mounted on the suspension line 1 with the free end of the suspension line 1 wound on to it to control and maintain the tension in the suspension line 1.

A general user placement area 48 is shown indicating that the user can use the equipment standing anywhere within the enclosed area formed by the segments of the suspension line 1 or outside the area based on requirement. In the general case, the suspension line 1 can be connected to multiple points spaced apart and located at different heights, as described earlier. The points are usually non-collinear, and the suspension line travels between these points in a sequence, forming a plurality of segments of the suspension line. The result is a substantially large and versatile training area having multiple segments, with multiple targets having different physical characteristics suspended from each segment. This supports a variety of training sessions for a user or even multiple simultaneous users having differing requirements. In practice, the punching bag system setup is completely upto the user, and can be configured in any manner based on the physical environment and user requirements.

Figure 13:
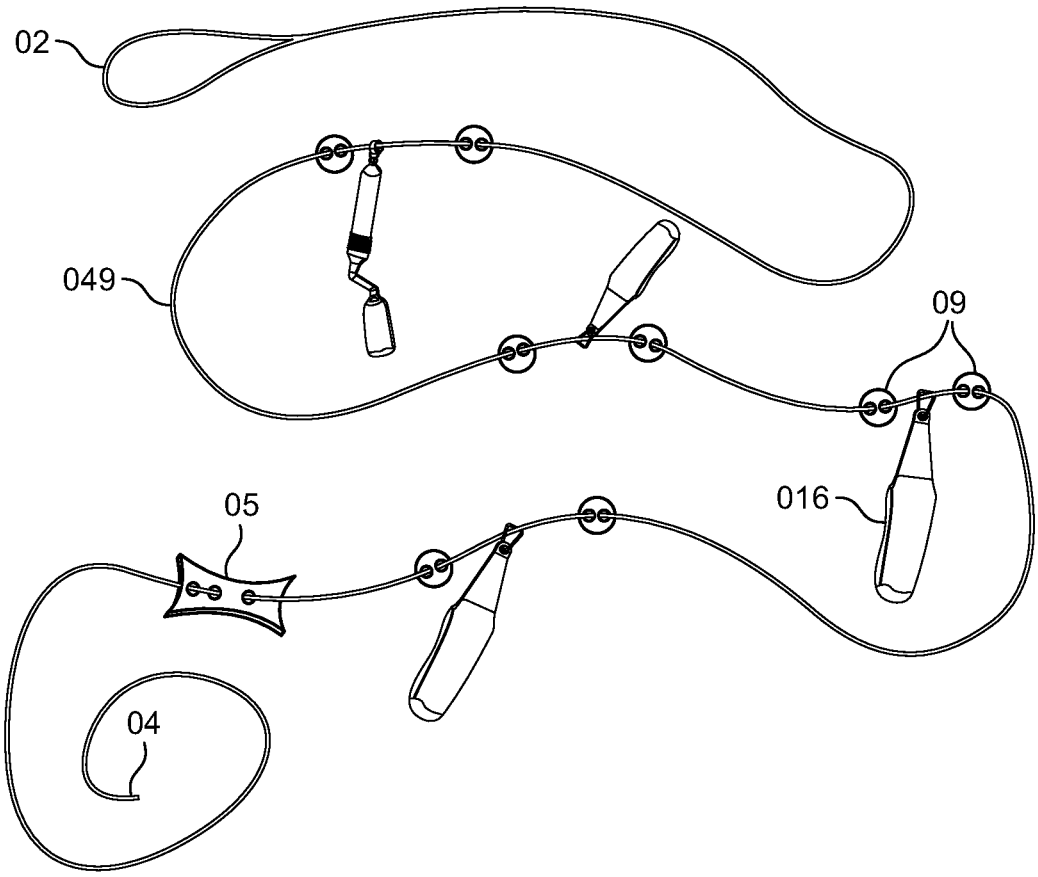
FIG. 13 shows a perspective view of the punching bag kit minus any mounting component according to an exemplary embodiment.
Figure 14:
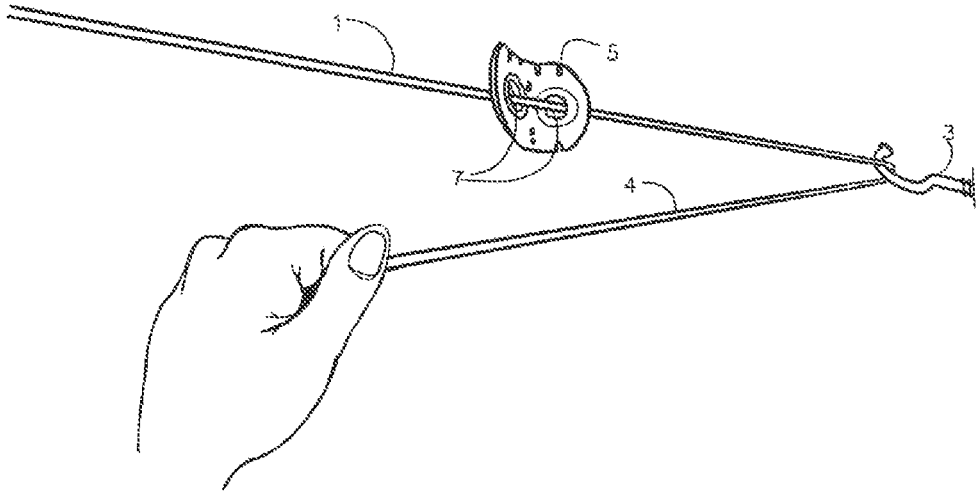
FIG. 14 shows a user pulling on the free end of the suspension line in order to set a user-desired tension level with a two-holed line tension device ready to be used to maintain the tension once set according to an exemplary embodiment.
Figure 15:
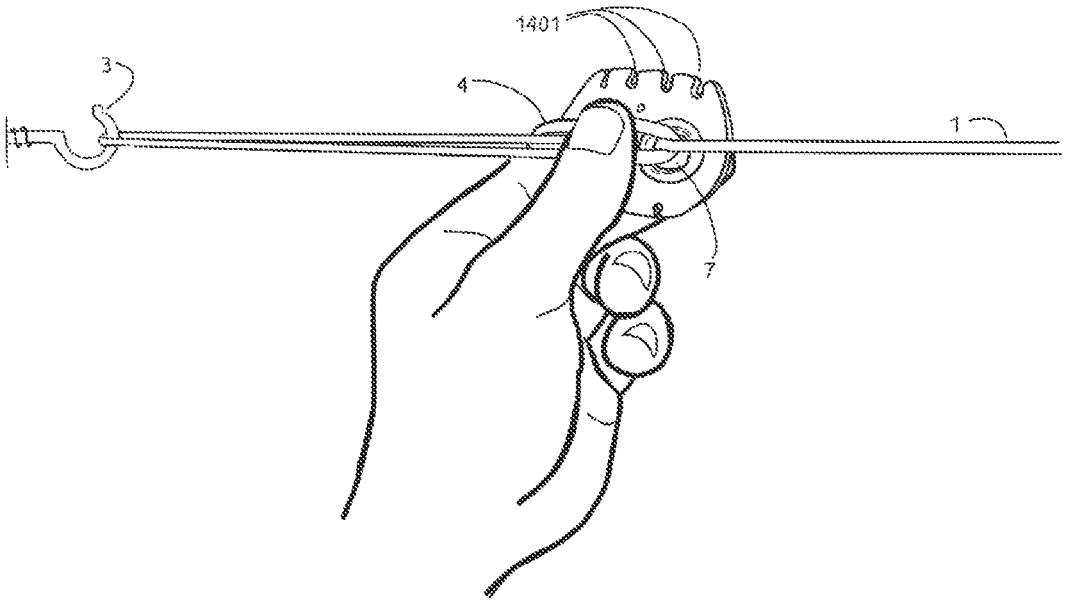
FIG. 15 shows the user of FIG. 14 after wrapping the free end of the suspension line around choke points to increase friction and prevent the line from slipping according to an exemplary embodiment.

FIG. 13 illustrates the components of the punching bag kit 49 according to an exemplary embodiment. Here, the suspension line 1 is shown with its two ends: the looped end 2 that is used to affix to a mounting point via an object mount 3 or base mount 41, and the free end 4 that can be connected or looped through as many points as required. A line tension device 5 is shown on the suspension line 1 near the free end 4 that will be used to adjust the tension in the suspension line 1. Four targets 16 having different physical characteristics are shown connected to the suspension line 1 along with two target blockers 9 for each target 16, one on either side.

The punching bag kit 49 as shown in this exemplary embodiment has an advantage of being portable and easy to setup in almost any environment. It is lightweight and compact enough to carry in a backpack. These features, in addition to the flexibility in terms of switching and adding targets to an already connected system without needing to dismantle anything, and the practically limitless number of configurations that the system can be setup in, make it a highly versatile and useful training system for the user.

Additional exemplary advantages in some embodiments includes the ease of use-both setup and teardown time are minimal and little hardware is required. The punchline kit 49 and associated parts of the assembled system are lightweight and extremely portable. The kit 49 and associated parts of the assembled system fit into small packaging such as a backpack or gym bag. The small size weight, and density in some embodiments, and customizable target bags allow light contact when struck by a user. Because of this, the product is ideal for some physiotherapy situations requiring low impact. Sound and vibration noise are minimal due to the general size and weight of the punching bag targets, but also from how the target bags attach to the suspension line 1. As they are not directly linked to the line but rather clasped to a portion of line between two blockers via clipping or opening/closing ring mechanism, the product is a good option for roommate situations or apartment living. The kit 49 and assembled system are versatile—they set up easily in almost any space. Less room is required to perform training actions. Limitless options and customizability allow for a variety of training regimes. Limitless placement options available for targets, wide target selection and the number of targets in play all help users create different scenarios. Utilizing punching bags as disclosed herein may help with improving focus/timing/reaction speed. The smaller, more difficult to strike targets as well as multiple targets in play, once struck react unlike a typical strike trainer, forcing quicker reaction and planned timing to keep consecutive strikes maintained. Likewise, hand or wrist protection may not be needed as the targets are lightweight with no fixed positioning. Punches and kicks are able to progress through targets with little fear of impact injury from target since the targets are able to swing freely and move freely along the suspension line. Users may utilize the system to execute proper technique, timing and follow through learnt through repetition, without heavy impact.

Additional advantages in some embodiments include minimal disruption of environment whilst punch/kick training, multiple environment mounting, and engineered quick simple method to attach and hold proper tension for supporting horizontal line component adapting to a multitude of environments. Diverse interchangeable targets, targets range in size, but generally remain but not limited to, cylindrical in shape and range in density. Targets interact with supporting horizontal component via a clipping mechanism allowing quick interchanging of possible multiple targets. Diverse striking environment allowing user to define one's striking needs to one's striking abilities, i.e., 360-degree multiple target set up to singular target set up.

An example of a practical application of the punching bag kit 49 and/or assembled system according to an exemplary embodiment includes MMA/boxing strike training in gym scenarios. The suspension line is mounted between upright gym equipment to localize strike workouts with weight workouts to maintain heart rate between weighted workout sets.

Another example of a practical application includes instructor-driven strike training, with the ability to place multiple targets on a single supporting line, and that said line able to traverse around multiple stationary objects, multiple users may use the same supporting member without major interference between user targets during engagement thereby allowing for classroom size instruction with light impact training tools.

Yet another example of a practical application includes home or physiotherapy light impact training allows for the user to engage in strike training without major interruptions to persons nearby, with the ability to be user defined and accommodate multiple possible environments to provide strike training.

Construction materials for the outer skins of the targets 16 is leather or canvas in some embodiments. Similar to most typical punching style bags, these materials are durable and withstand abuse. The inner filler for the bags is a soft elastic plastic packed inside the target body cavity to the specific required density. The plastic gives the bags their weight and provides a solid contact feeling while striking. Grommet reinforcements 13 are provided for the holes in some embodiments to strengthen the connection mechanism. Malleable leather strips located in the target bag neck 19 give the bag a controlled swinging action. A carabiner clipping mechanism 17 is used for connection method of target bag to horizontal suspension member in some embodiments. This method provides fast easy means to apply or remove target bag. A quality thin nylon support member utilized for the suspension line 1 provides elasticity and ability to absorb shock and has good abrasion resistance. Additional components such as blockers 9 and the line tension device 5 are made of leather or nylon in some embodiments as a construction material as for its malleability, durability, sound and impact resilience.

The suspension line 1 may be suspended between any stationary mounting positions; for example, posts, handles, hooks, trees, or weighted objects to use as a mount, or wooden construction studs behind drywall or another style of sturdy construction to mount either base mounts 41 or quick mounts 3 too.

For safety purposes such as to reduce the potential the suspension line 1 component could "closeline" a user or unsuspecting individual, the suspension line 1 may be colored brightly (e.g., red) to identify its position, the suspension line 1 component itself has elastic properties and will absorb a potential "closeline" incident by stretching. In some embodiments, the suspension line 1 component is mounted above a maximum height of the users to help reduce chances of unintended contact.

According an exemplary embodiment, a punching bag kit includes a suspension line, a target having a fastening mechanism for suspending the target from the suspension line in a manner allowing the target to move along the suspension line, and a blocker positioned on the suspension line at a configurable distance from the target. The blocker is frictionally held in place on the suspension line at the configurable distance. Movement of the target along the suspension line is restricted upon the fastening mechanism of the target impacting the blocker. The blocker is physically larger than the fastening mechanism thus impeding travel of the fastening mechanism along the suspension line past the blocker. The blocker may have holes through which the suspension line passes, and a spring-loaded friction device may be mounted on the suspension line between two holes. The suspension line may travel around a user in plurality of segments suspending one or more targets.

Although the invention has been described in connection with preferred embodiments, it should be understood that various modifications, additions and alterations may be made to the invention by one skilled in the art without departing from the spirit and scope of the invention. For example, although the blockers have been shown above with two or three holes, any number of holes may be utilized in other embodiments. When referring to the first hole and second hole of the blocker through which the suspension line passes, the first hole and the second hole do not need to be consecutive holes in some embodiments.

The loop of material forming the fastening mechanism of the target 16 in some embodiments includes a section that opens to a size at least of the thickness of the suspension line 1 to allow the fastening mechanism to be mounted to the suspension line 1 while it is suspended between two mounting points. However, in some embodiments, the opening of the fastening mechanism may open to a size less than the thickness of the suspension line 1 while still allowing the suspension line 1 to be squeezed through. In some embodiments, the suspension line 1 is made of a compressible material.

All combinations and permutations of the above described features and embodiments may be utilized in conjunction with the invention.

What is claimed is:

1. A punching bag kit comprising:

a suspension line;

a target having a fastening mechanism for suspending the target from the suspension line in a manner allowing the target to move along the suspension line; and a blocker for being positioned on the suspension line at a configurable distance from the target;

wherein the blocker is frictionally held in place on the suspension line at the configurable distance;

movement of the target along the suspension line is restricted upon the fastening mechanism of the target impacting the blocker;

the blocker is physically larger than the fastening mechanism thus impeding travel of the fastening mechanism along the suspension line past the blocker;

the blocker comprises a plurality of holes including at least a first hole and a second hole through which the suspension line passes;

the punching bag kit further includes a friction device for mounting on the suspension line between the first hole and the second hole of the blocker;

the suspension line passes through the friction device; and the friction device and thereby, the blocker, are frictionally held in place on the suspension line by a clamping force of the friction device.

2. The punching bag kit of claim 1, wherein:

the friction device is spring-loaded; and the friction device and thereby, the blocker, are frictionally held in place on the suspension line by the clamping force of a spring of the friction device.

3. The punching bag kit of claim 1, wherein the fastening mechanism is a loop of material having an aperture through which the suspension line passes.

4. The punching bag kit of claim 3, wherein the loop of material includes a section that opens wide enough for moving a thickness of the suspension line in and out of the aperture allowing the fastening mechanism to be connected to and disconnected from the suspension line.

5. The punching bag kit of claim 3, wherein the loop of material is a carabiner.

6. The punching bag kit of claim 5, wherein the carabiner includes a movable gate allowing the carabiner to be clipped to the suspension line without requiring an end of the suspension line to be passed through an aperture of the carabiner.

7. The punching bag kit of claim 3, wherein the loop of material is formed by a strap.

8. The punching bag kit of claim 7, wherein the strap includes one or more snaps allowing the strap to be wrapped around the suspension line without requiring an end of the suspension line to be passed through an aperture of the loop formed by the strap.

9. The punching bag kit of claim 3, wherein the loop of material is a ring formed by one or more sections of rigid material.

10. The punching bag kit of claim 9, wherein the ring includes a slit allowing ends of the ring that meet at the slit to be pulled apart by a user thereby allowing the ring to be wrapped around the suspension line without requiring an end of the suspension line to be passed through an aperture of the ring.

11. The punching bag kit of claim 1, further comprising:

a plurality of blockers including a first blocker for positioning on the suspension line on a first side of the target and a second blocker for positioning on the suspension line on a second side of the target;

whereby travel of the fastening mechanism of the target along the suspension line is impeded from leaving a target movement range along the suspension line formed by a distance between the first blocker and the second blocker.

12. The punching bag kit of claim 1, further comprising:

a line tension device comprising a plurality of holes for the suspension line to pass through before extending to a loop on an external mounting point;

wherein, in usage, a free end of the suspension line is passed through the loop on the external mounting point and is returned back to the line tension device where it is pulled by a user to a desired tension level and wrapped around a plurality of choke points formed where the suspension line passes through the holes of the line tension device; and friction of the suspension line against itself at the choke points controls and maintains tension in the suspension line at the desired tension level.

13. The punching bag kit of claim 12, wherein:

the line tension device further comprises one or more grooves having a width less than a thickness of the suspension line; and in usage, after the suspension line is wrapped around the plurality of choke points, the free end of the suspension line is frictionally held in the one or more grooves for preventing unintended unwrapping of the suspension line from the choke points.

14. The punching bag kit of claim 1, further comprising a plurality of targets for simultaneously suspending from the suspension line.

15. The punching bag kit of claim 14, wherein at least two of the plurality of targets have different physical characteristics thereby allowing a plurality of target configurations along the suspension line.

16. A punching bag system comprising:

a suspension line suspended between a plurality of mounting points;

a target suspended from the suspension line using a fastening mechanism in a manner allowing the target to move along the suspension line; and a blocker positioned on the suspension line at a configurable distance from the target;

wherein the blocker is frictionally held in place on the suspension line at the configurable distance;

movement of the target along the suspension line is restricted upon the fastening mechanism of the target impacting the blocker;

the blocker is physically larger than the fastening mechanism thus impeding travel of the fastening mechanism along the suspension line past the blocker;

the blocker comprises a plurality of holes including at least a first hole and a second hole through which the suspension line passes;

the punching bag system further includes a friction device mounted on the suspension line between the first hole and the second hole of the blocker;

the suspension line passes through the friction device; and the friction device and thereby, the blocker, are frictionally held in place on the suspension line by a clamping force of the friction device.

17. The punching bag system of claim 16, wherein:

the friction device is spring-loaded; and the friction device and thereby, the blocker, are frictionally held in place on the suspension line by the clamping force of a spring of the friction device.

18. The punching bag system of claim 16, wherein:

the plurality of mounting points between which the suspension line is suspended includes at least three mounting points positioned non-collinearly around a user placement area; and the suspension line travels between the mounting points in a sequence forming a plurality of segments of the suspension line around the user placement area for suspending one or more targets on different sides of the user placement area.

19. The punching bag system of claim 16, wherein at least two of the plurality of mounting points are at different heights thereby allowing a segment of the suspension line to be suspended at a user-defined slope.

20. The punching bag system of claim 16, further comprising:

a line tension device comprising a plurality of holes through which the suspension line passes before extending to a loop on one of the mounting points;

wherein, in usage, a free end of the suspension line is passed through the loop and is returned back to the line tension device where it is pulled by a user to a desired tension level and wrapped around a plurality of choke points formed where the suspension line passes through the holes of the line tension device; and friction of the suspension line against itself at the choke points controls and maintains tension in the suspension line at the desired tension level.

21. A punching bag kit comprising:

a suspension line;

a target having a fastening mechanism for suspending the target from the suspension line in a manner allowing the target to move along the suspension line; and a blocker for being positioned on the suspension line at a configurable distance from the target;

wherein the blocker is frictionally held in place on the suspension line at the configurable distance;

movement of the target along the suspension line is restricted upon the fastening mechanism of the target impacting the blocker;

the blocker is physically larger than the fastening mechanism thus impeding travel of the fastening mechanism along the suspension line past the blocker;

the punching bag kit further comprises a line tension device comprising a plurality of holes for the suspension line to pass through before extending to a loop on an external mounting point;

wherein, in usage, a free end of the suspension line is passed through the loop on the external mounting point and is returned back to the line tension device where it is pulled by a user to a desired tension level and wrapped around a plurality of choke points formed where the suspension line passes through the holes of the line tension device; and friction of the suspension line against itself at the choke points controls and maintains tension in the suspension line at the desired tension level.

22. A punching bag system comprising:

a suspension line suspended between a plurality of mounting points;

a target suspended from the suspension line using a fastening mechanism in a manner allowing the target to move along the suspension line; and a blocker positioned on the suspension line at a configurable distance from the target;

wherein the blocker is frictionally held in place on the suspension line at the configurable distance;

movement of the target along the suspension line is restricted upon the fastening mechanism of the target impacting the blocker;

the blocker is physically larger than the fastening mechanism thus impeding travel of the fastening mechanism along the suspension line past the blocker;

the plurality of mounting points between which the suspension line is suspended includes at least three mounting points positioned non-collinearly around a user placement area; and the suspension line travels between the mounting points in a sequence forming a plurality of segments of the suspension line around the user placement area for suspending one or more targets on different sides of the user placement area.

23. A punching bag system comprising:

a suspension line suspended between a plurality of mounting points;

a target suspended from the suspension line using a fastening mechanism in a manner allowing the target to move along the suspension line; and a blocker positioned on the suspension line at a configurable distance from the target;

wherein the blocker is frictionally held in place on the suspension line at the configurable distance;

movement of the target along the suspension line is restricted upon the fastening mechanism of the target impacting the blocker;

the blocker is physically larger than the fastening mechanism thus impeding travel of the fastening mechanism along the suspension line past the blocker;

the punching bag system further comprises a line tension device comprising a plurality of holes through which the suspension line passes before extending to a loop on one of the mounting points;

wherein, in usage, a free end of the suspension line is passed through the loop and is returned back to the line tension device where it is pulled by a user to a desired tension level and wrapped around a plurality of choke points formed where the suspension line passes through the holes of the line tension device; and friction of the suspension line against itself at the choke points controls and maintains tension in the suspension line at the desired tension level.

* * * * *